US009004231B2

(12) United States Patent
Weinberger

(10) Patent No.: US 9,004,231 B2
(45) Date of Patent: Apr. 14, 2015

(54) ELEVATOR INSTALLATION WITH A SOUND PICK-UP

(75) Inventor: Karl Weinberger, Immensee (CH)

(73) Assignee: Inventio AG, Hergiswil (CH)

( * ) Notice: Subject to any disclaimer, the term of this patent is extended or adjusted under 35 U.S.C. 154(b) by 706 days.

(21) Appl. No.: 13/313,342

(22) Filed: Dec. 7, 2011

(65) Prior Publication Data

US 2012/0138391 A1 Jun. 7, 2012

(30) Foreign Application Priority Data

Dec. 7, 2010 (EP) ..... 10194033

(51) Int. Cl.
*B66B 1/34* (2006.01)
*B66B 5/00* (2006.01)

(52) U.S. Cl.
CPC ..... *B66B 5/0031* (2013.01); *B66B 5/0025* (2013.01)

(58) Field of Classification Search
USPC ..... 187/247, 391, 393
See application file for complete search history.

(56) References Cited

U.S. PATENT DOCUMENTS

| | | | | |
|---|---|---|---|---|
| 5,135,079 | A * | 8/1992 | Shimazaki | 187/264 |
| 8,450,952 | B2 * | 5/2013 | Lahteenmaki | 318/34 |
| 2010/0155181 | A1 * | 6/2010 | Coquerelle et al. | 187/266 |
| 2014/0008152 | A1 * | 1/2014 | Annen et al. | 187/247 |

FOREIGN PATENT DOCUMENTS

| | | | |
|---|---|---|---|
| CN | 101580198 | A | 11/2009 |
| JP | 2007137647 | A | 6/2007 |
| JP | 2007197150 | A | 8/2007 |
| JP | 2009274805 | A * | 11/2009 |
| WO | 2009126140 | A1 | 10/2009 |

OTHER PUBLICATIONS

Translation JP 2009274805 A.*

* cited by examiner

*Primary Examiner* — Anthony Salata
(74) *Attorney, Agent, or Firm* — Fraser Clemens Martin & Miller LLC; William J. Clemens

(57) ABSTRACT

An elevator installation includes a cage, a counterweight which balances the cage and a supporting and/or drive structure at which the cage and the counterweight are suspended. The elevator installation has a sound pick-up designed for detecting solid-borne sound generated at the counterweight.

16 Claims, 2 Drawing Sheets

ELEVATOR INSTALLATION WITH A SOUND PICK-UP

CROSS-REFERENCE TO RELATED APPLICATION

This application claims priority to European Patent Application No. 10194033.6, filed Dec. 7, 2010, which is incorporated herein by reference.

FIELD

The present disclosure relates to an elevator installation with a sound pick-up for detection of solid-borne sound.

BACKGROUND

In an elevator installation with a cage and a counterweight for balancing the weight force of the cage the counterweight is typically suspended at a supporting and/or drive means by way of a bearing and guided by means of guide elements at guide rails. Such bearing and guide elements can represent starting points for dire faulty functioning of the elevator installation, because in the case of failure of these elevator components the counterweight can either crash down or tilt at the guide rails and become stuck. Both can lead to damage and to costly repair of the elevator installation.

In the case of a conventional elevator installation the cage is supplied with electrical energy. This typically takes place by way of a hanging cable which connects the cage with a power main. Such an energy supply is, however, not provided for the counterweight.

SUMMARY

At least some of the disclosed embodiments provide for a monitoring of elevator components at the counterweight, for example, a bearing or a guide element, with consideration of the specific energy supply circumstances of the counterweight.

According to one aspect an elevator installation comprises a cage, a counterweight which balances the cage and a supporting and/or drive means at which the cage and the counterweight are suspended. A sound pick-up is coupled with the elevator installation and is designed for the purpose of detecting solid-borne sound generated at the counterweight.

In at least some cases, elevator components lying at the counterweight can be monitored in simple manner by means of the sound pick-up, because the sound pick-up can be positioned at a point in the shaft which can be supplied with energy in simple manner. A complicated energy supply of the counterweight is thus not necessary. The sound pick-up can in this regard be coupled in particularly simple manner to the supporting and/or drive means or to a guide plane of the counterweight. Not only the supporting and/or drive means, but also the guide plane of the counterweight, for example a guide rail, transmits solid-borne sound from the counterweight to the sound pick-up.

According to a further aspect the supporting and/or drive means forms between a first end thereof and a first deflecting roller a loop in which the counterweight is suspended by way of a bearing.

A possible advantage of such a 2:1 suspension of the counterweight lies in the use of smaller drives, wherein the drive power to be produced by the drive is approximately halved. The counterweight can also be suspended 1:1, thus directly hanging at one end of the supporting and/or drive means, or in any other suspension ratio which is higher than 2:1, thus, for example 3:1 or 4:1.

In the case of a 2:1 suspension of the counterweight the counterweight is typically suspended at a counterweight support roller in the loop of the supporting and/or drive means. The connection between this counterweight support roller and the counterweight is realized by means of bearing. The bearing in that case forms a rotational axis about which the counterweight support roller rotates. The bearing of the counterweight support roller can be subject to a progressive aging process which can lead to functional failure of the bearing. The connection between the counterweight support roller and the bearing can then, for example, detach and the counterweight crash down.

The play between the bearing and the counterweight support roller as well as the rotational movement of the counterweight support roller itself generate vibrations which lie in a typical frequency and/or amplitude range. The vibrations change with the course of time or with increasing wear of the bearing and/or of the counterweight support roller. The vibrations are transmitted as solid-borne sound by way of the supporting and drive means or the guide plane of the counterweight to the sound pick-up. In that case the course of vibration over time is detected by the sound pick-up.

According to a further aspect the counterweight is guided by means of at least one guide element at a guide plane. In that case the guide element can represent a guide shoe, a guide roller or the like. Moreover, the guide plane is realized as a guide rail or as a guide cable or the like.

The guidance of a counterweight by means of guide elements at a guide plane is often necessary for safety reasons. Such a guidance keeps the counterweight on a predetermined travel path and prevents impermissible oscillation of the counterweight in the shaft.

A guide shoe or a guide roller is at the mercy of a wear and ageing process with an ongoing period of use. Thus, for example, guide surfaces of the guide shoe or the bearings of the guide roller are worn. The wear of these guide elements can lead to a functional failure, in which case there is possibly no longer a guarantee of reliable guidance of the counterweight.

A play is present between the guide element and the guide surface. This play during travel of the counterweight leads to vibrations which propagate as solid-borne sound, for example, in the guide rails or—via suspension bearings of the counterweight—in the supporting and/or drive means.

In disturbance-free operation with intact functional capability of the guide elements the vibrations between the guide elements and, for example, a guide rail lie in a characteristic frequency range and/or amplitude range. With increasing wear of the guide elements and/or of the guide surface this frequency range or amplitude range correspondingly changes. These changes in the vibration behavior can be detected by the sound pick-up via transmission of solid-borne sound.

According to a further aspect the sound pick-up is coupled to the first end of the supporting and/or drive means.

Possible advantages of this sound pick-up arrangement can reside in the fact that an end of the supporting and/or drive means is stationary with respect to its suspension point, i.e. the sound pick-up can be coupled in particularly simple manner to the end of the supporting and/or drive means.

Alternatively, the sound pick-up is coupled to the guide plane of the counterweight. In this arrangement as well the sound pick-up can be mounted in particularly simple manner on an elevator component which is stationary with respect to the travel path of the counterweight, such as, for example, a guide rail.

According to a further aspect an evaluating circuit is connected with the sound pick-up and evaluates the detected solid-borne sound. The evaluating circuit comprises at least a processor and a memory unit.

Some embodiments comprise a method of operating the above elevator installation, wherein the sound pick-up detects solid-borne sound which is generated at the counterweight and transmitted by means of the supporting and/or drive means. The evaluating circuit possibly evaluates the detected solid-borne sound.

By means of the evaluating circuit the solid-borne sound detected by the sound pick-up is evaluated with respect to frequency and/or amplitude as a frequency spectrum. The evaluated frequency spectrum is compared with at least one frequency spectrum, which represents an operational value and is stored in the evaluating circuit. In that case the evaluation of the solid-borne sound and the comparison of the frequency spectra are undertaken in the processor. The stored frequency spectrum or the operational value is filed in the memory unit.

The stored frequency spectrum can correspond with a frequency spectrum which embraces at least the characteristic frequencies and/or amplitudes of the elevator components, which are to be monitored, in permissible operation. In this regard, it is a permissible operational value. If the evaluated frequency spectrum corresponds with the stored frequency spectrum, a positive evaluation result is present. There is thus adherence to the permissible operational value.

Alternatively, the stored frequency spectrum can represent a permissible operational value. Here, too, the frequency spectrum comprises at least those characteristic frequencies and/or amplitudes which arise in the case of impermissible operation of the elevator components to be monitored. A positive evaluation result is then present here as long as the evaluated frequency spectrum does not correspond with the stored frequency spectrum. The impermissible operational value is thus not reached.

In some embodiments several frequency spectra are stored in the evaluating circuit, which represent at least one permissible and/or impermissible operational value. In this case, the evaluated frequency spectrum is compared with several stored frequency spectra. If the evaluated frequency spectrum corresponds with one of the stored frequency spectra of a permissible operational value or as long as the evaluated frequency spectrum does not correspond with any of the stored frequency spectra of an impermissible operational value a positive evaluation result is present. The evaluation result here possibly includes the mode of operation of the elevator installation such as, for example, a normal operation or a maintenance operation, with which a permissible operational value is associated. In addition, the evaluation result comprises at least information about which elevator component, for example a bearing or a guide element, has reached the impermissible operational value.

According to a further aspect of the method the evaluating circuit compares the detected solid-borne sound with an operational value and in the case of detection of an operational disturbance triggers a change-of-state alarm. In particular, the evaluating circuit compares the detected solid-borne sound with a permissible operational value and in the case of deviation from the permissible operational value triggers the change-of-state alarm. Alternatively thereto, the evaluating circuit compares the detected solid-borne sound with an impermissible operational value and on reaching the impermissible operational value triggers a change-of-state alarm.

The change-of-state alarm indicates that the elevator component to be monitored such as, for example, a bearing or a guide element of the counterweight is to be replaced or repaired.

Accordingly, not only a damaged bearing by way of which the counterweight is suspended at the drive and/or support means, but also a damaged guide element which guides the counterweight at the guide plane triggers the change-of-state alarm.

According to a further aspect of the disclosed technologies in the case of a change-of-state alarm the elevator installation is provided for a maintenance operation. In this regard, a maintenance engineer is instructed to service the elevator installation. The change-of-state alarm possibly includes information about which of the elevator components to be monitored has reached the impermissible operational value. This simplifies fault diagnosis and shortens the maintenance work.

According to a further aspect of the disclosed technologies, in the case of a change-of-state alarm the elevator installation is stopped. Through stopping of the elevator installation the occurrence of a dire faulty function can be prevented. As a consequence, the stopped elevator installation is provided for a maintenance operation.

BRIEF DESCRIPTION OF THE DRAWINGS

The disclosed technologies are clarified and further described in the following by exemplifying embodiments and a drawing, in which.

DETAILED DESCRIPTION

Figure 1:
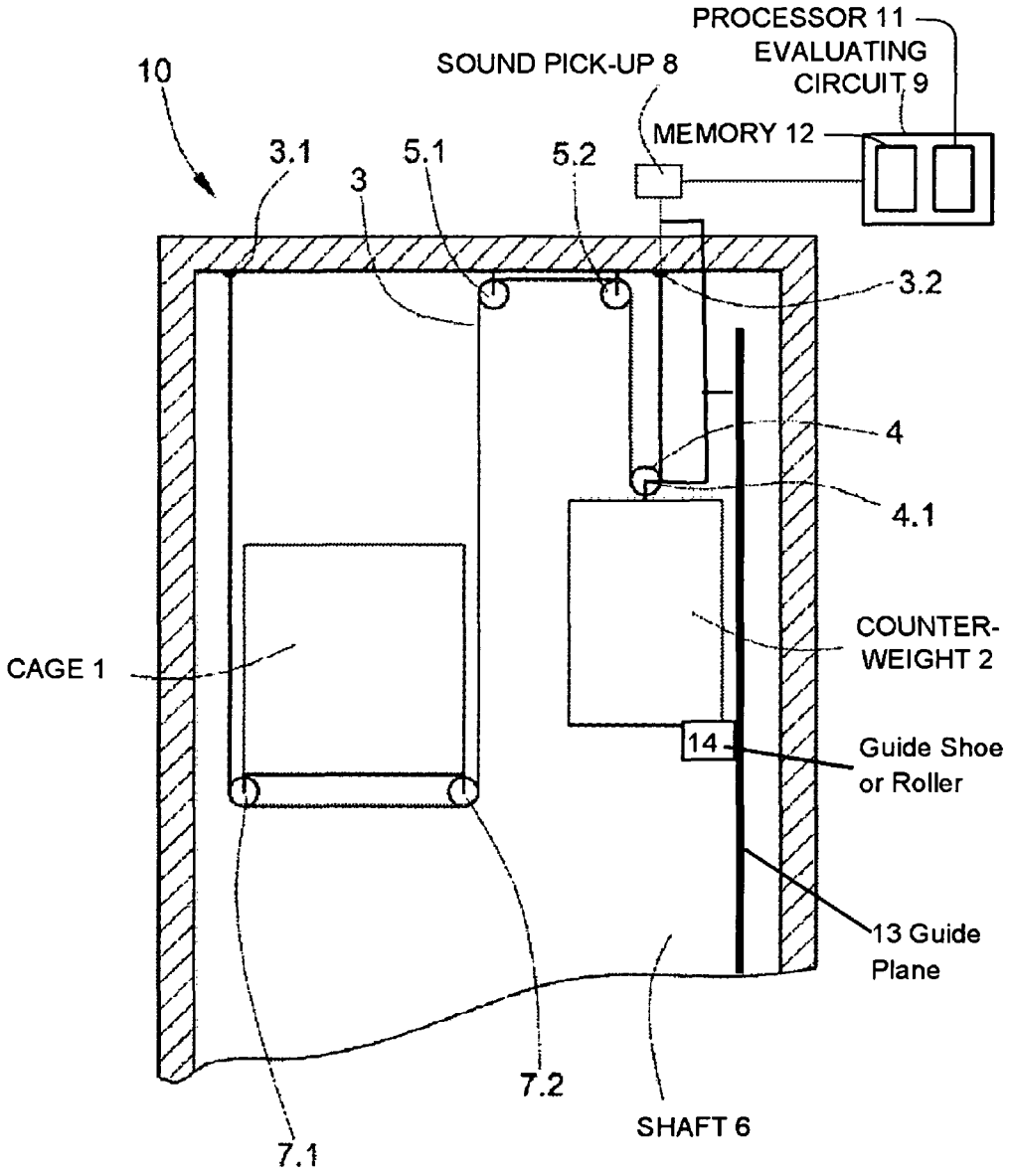
FIG. 1 shows a first form of embodiment of the elevator installation with a sound pick-up for detection of solid-borne sound which is produced by a faulty function of an elevator component at the counterweight.

FIG. 1 shows an elevator installation 10. This elevator installation comprises a cage 1, a counterweight 2, a supporting and drive means or structure 3 at which the cage 1 and the counterweight 2 are suspended in a shaft 6 in a 2:1 ratio and by way of a drive pulley 5.1. The supporting and drive structure 3 typically is formed as a cable or a belt. The drive pulley 5.1 is connected with a drive unit, which is not illustrated in FIG. 1 for reasons of clarity, and is disposed in operative contact with the supporting and drive means 3.

The cage 1 and the counterweight 2 are movable substantially along vertically oriented guide planes 13 by means of a rotational movement of the drive pulley 5.1 which transmits a drive moment of the drive unit to the supporting and drive means 3. For reasons of clarity, the cage guide planes are not illustrated in FIG. 1. The cage 1 and the counterweight 2 are guided by means of guide elements such as, for example, guide shoes or guide rollers 14 at the guide planes 13.

The counterweight 2 is in that case suspended in a first loop of the supporting and drive means 3. The first loop is formed by a part of the supporting and drive means which lies between a first end 3.2 of the supporting drive means 3 and a deflecting roller 5.2. The counterweight 2 is suspended at the first loop by means of a bearing 4.1. For that purpose the counterweight 2 is coupled with the bearing 4.1. In the illustrated example the bearing 4.1 represents the fulcrum of a counterweight support roller 4. In that case, the supporting and/or drive means 3 runs from a first fixing point, to which the first end 3.2 of the supporting and/or drive means is fastened, downwardly to the counterweight support roller 4. The supporting and/or drive means 3 loops around the counterweight support roller 4 through approximately 180° and then runs upwardly to the first deflecting roller 5.2.

The cage 1 is suspended in a second loop of the supporting and/or drive means 3. The second loop is formed by a part of the supporting and/or drive means which lies between a second end 3.1 of the supporting and/or drive means 3 and a second drive pulley 5.1. The cage 1 is suspended at the second loop by means of two cage support rollers 7.1, 7.2. In that case, the supporting and/or drive means 3 runs from a second fixing point, at which the second end 3.1 of the supporting and/or drive means is fastened, downwardly to a first cage support roller 7.1. The supporting and/or drive means 3 loops around the first cage support roller 7.1 through approximately 90°, then runs substantially horizontally to a second cage support roller 7.2 and loops around the second cage support roller 7.2 through approximately 90°. The supporting and/or drive means 3 further runs upwardly to the drive pulley 5.1. From the drive pulley 5.1 the supporting and/or drive means 3 finally runs to the first deflecting roller 5.2.

The two fixing points at which the first and the second ends 3.2, 3.1 of the supporting and/or drive means 3 are fastened, the deflecting roller 5.2, the drive pulley 5.1 and the guide rails of the cage 1 and the counterweight 2 are coupled indirectly or directly to a load-bearing structure, typically shaft walls.

The first end 3.2 of the supporting and/or drive means 3 is coupled with a sound pick-up 8. The sound pick-up 8 detects solid-borne sound which the supporting and/or drive means 3 transmits thereto.

In an alternative form of embodiment the sound pick-up is coupled to a guide rail of the counterweight 2. In this case the sound pick-up 8 detects solid-borne sound which the guide rail transmits to the sound pick-up 8.

The solid-borne sound arises during operation of the elevator installation 10 due to vibrations at elevator components. For example, vibrations arise due to the play between the guide elements of the cage 1 or the guide elements of the counterweight 2 and the corresponding guide rails, due to the drive unit, due to the play in the bearing of the deflecting roller 5.2, drive pulley 5.1, cage support roller 7.1, 7.2 and counterweight support roller 4, as well as the vibrations of the supporting and/or drive means 3 itself.

For example, the bearing 4.1 at which the counterweight 2 is suspended as well as guide elements at which the counterweight 2 is guided at guide rails generate vibrations which lie in a characteristic frequency and amplitude range. In the course of time these elevator components are subjected to wear phenomena, which are reflected by a changed frequency and amplitude range.

The sound pick-up possibly detects solid-borne sound in a frequency range between 5 and 60,000 Hz, particularly between 5 and 2,500 Hz.

An evaluating circuit 9 is provided for evaluation of the detected solid-borne sound. The evaluating circuit 9 is for that purpose connected with the evaluating circuit 9 by way of a signal transmission path, typically a signal line. However, other means for transmission of signals are known, such as, for example, cable-free signal transmission techniques, and one can readily use these here.

The sound pick-up 8 transforms the detected solid-borne sound into a signal and transmits this signal to the evaluating circuit 9 by way of the signal transmission path. The evaluating circuit 9 comprises at least one processor 11 and memory unit 12. Signals entering from the sound pick-up 8 are in that case spectrally analyzed by the processor, particularly the frequencies and amplitudes of the transmitted solid-borne sound. This spectral analysis leads to a frequency spectrum. The processor can now compare this frequency spectrum with one or more frequency spectra stored in the memory unit.

The frequency spectra stored in the memory unit correspond with different operational values. An operational value can represent not only a permissible operational value, but also an impermissible operational value. Thus, in the case of a comparison of the detected frequency spectrum with the stored frequency spectra a conclusion can be made not only about adherence to a permissible operational value, but also additionally about which form of operation, which corresponds with a permissible operational value, is present or even, when an impermissible operational value is reached, about which form of operational disturbance has occurred. Thus, for example, a conclusion can be made whether the bearing 4.1 or a guide element is damaged.

If the transmitted frequency spectrum differs from a permissible operational value or if the transmitted frequency spectrum reaches an impermissible operational value a change-of-state alarm is preferably triggered by the evaluating circuit 9. The triggering of the change-of-state alarm in that case can have the consequence that the elevator installation 10 is provided for a maintenance operation in which the operational disturbance of the elevator installation 10 is eliminated. For example, a service center is warned, which instructs a maintenance engineer to service the corresponding elevator installation 10. Alternatively, in the case of triggering of a change-of-state alarm the maintenance engineer is directly made aware, by way of a mobile radio receiving system connected with the elevator installation, to service the corresponding elevator installation 10.

The maintenance engineer is possibly informed about the nature of the operational disturbance. In this case, the maintenance engineer can procure specific exchange material in order to be able to reinstate the elevator installation as quickly and efficiently as possible.

For safety reasons the elevator installation can also be stopped when a change-of-state alarm arises. In this case a maintenance engineer is similarly instructed to service the elevator installation 10 and place it in operation again.

Figure 2:
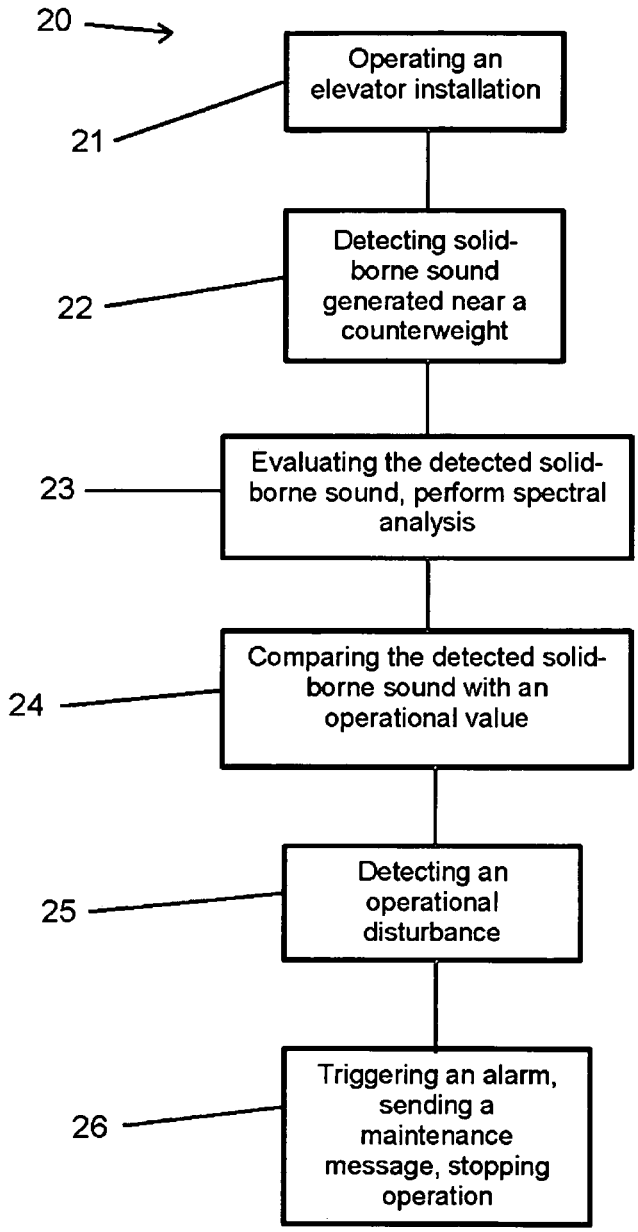
FIG. 2 is a flow diagram of the method steps for an elevator installation operating method according to the invention.

There is shown in FIG. 2 an elevator installation operating method 20 according to the invention, comprising: a step 21 of operating the elevator installation 10; a step 22 of detecting solid-borne sound generated near the counterweight 2 of the elevator installation using the sound pick-up 8 coupled to the elevator installation at one of the supporting and drive structure 3 suspending the counterweight 2 and the guide plane 13 of the counterweight and configured to detect the solid-borne sound; a step 23 of evaluating the detected solid-borne sound using the evaluating circuit 9; a step 24 of comparing the detected solid-borne sound with an operational value; a step 25 of as a result of the comparing, detecting an operational disturbance; and a step 26 of triggering an alarm, sending a maintenance message and/or stopping operation of the elevator installation. The step 23 can include performing spectral analysis of solid-borne signals.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator installation comprising:

a cage;

a counterweight;

a supporting and drive structure from which the cage and the counterweight are suspended;

a sound pick-up coupled to one of the supporting and drive structure and a guide plane of the counterweight and configured to detect solid-borne sound generated in the one of the supporting and drive structure and a guide plane near the counterweight; and an evaluating circuit connected to the sound pick-up, the evaluating circuit being configured to evaluate the detected solid-borne sound and trigger an alarm when the detected solid-borne sound represents an operational disturbance in the elevator installation.

2. The elevator installation of claim 1, the supporting and drive structure forming a loop between an end of the supporting and drive structure and a deflecting roller, the counterweight being suspended in the loop by a bearing, the sound pick-up being configured to monitor the bearing for detecting the solid-borne sound.

3. The elevator installation of claim 1, the supporting and drive structure comprising a cable.

4. The elevator installation of claim 1, the supporting and drive structure comprising a belt.

5. The elevator installation of claim 1, the counterweight being configured to be guided by at least one guide element at the guide plane, the sound pick-up being configured to monitor the at least one guide element for detecting the solid-borne sound.

6. The elevator installation of claim 5, the at least one guide element comprising a guide shoe or a guide roller.

7. The elevator installation of claim 5, the guide plane comprising a guide rail or a guide cable.

8. The elevator installation of claim 1, the sound pick-up being coupled to an end of the supporting and drive structure.

9. An elevator installation operating method, comprising:

operating an elevator installation;

detecting solid-borne sound generated near a counterweight of the elevator installation using a sound pick-up coupled to the elevator installation at one of a supporting and drive structure suspending the counterweight and a guide plane of the counterweight and configured to detect the solid-borne sound;

evaluating the detected solid-borne sound using an evaluating circuit;

comparing the detected solid-borne sound with an operational value, as a result of the comparing, detecting an operational disturbance; and triggering an alarm.

10. The elevator installation operating method of claim 9, the detected solid-borne sound being generated by a damaged bearing in the elevator installation.

11. The elevator installation operating method of claim 9, the detected solid-borne sound being generated by a damaged guide element for the counterweight.

12. The elevator installation operating method of claim 9, further comprising sending a maintenance message.

13. The elevator installation operating method of claim 9, further comprising stopping operation of the elevator installation.

14. The elevator installation operating method of claim 9, the evaluating comprising:

comparing the detected solid-borne sound with a permissible operational value;

as a result of the comparing, detecting a deviation from the permissible operational value; and triggering an alarm.

15. The elevator installation operating method of claim 9, the evaluating comprising:

comparing the detected solid-borne sound with an impermissible operational value;

as a result of the comparing, determining that the impermissible operational value has been reached; and triggering an alarm.

16. A processor-readable memory having stored therein instructions that, when executed by a processor, cause the processor to perform a method, the method comprising:

performing spectral analysis of solid-borne signals generated near a counterweight in an elevator installation and received by a sound pick-up in the elevator installation coupled to one of a supporting and drive structure suspending the counterweight and a guide plane of the counterweight, the performing the spectral analysis generating a frequency spectrum;

comparing the generated frequency spectrum with one or more stored frequency spectra;

as a result of the comparing, detecting an operational disturbance; and triggering an alarm.

* * * * *